US005900090A

United States Patent [19]

Distefano et al.

[11] Patent Number: 5,900,090

[45] Date of Patent: May 4, 1999

[54] APPARATUS AND METHOD FOR SETTING A GAP BETWEEN STRIPS OF WEB

[76] Inventors: Joseph Distefano, Hilton; Vladimir A. Garris, deceased, late of Rochester, by Galina Garris, executor; Renee H. Locke, Rochester; William E. Robinson, Canandaigua, all of N.Y.

[21] Appl. No.: 08/858,642

[22] Filed: May 19, 1997

[51] Int. Cl.[6] ..... B65H 21/00

[52] U.S. Cl. ..... 156/159; 156/304.3; 156/505; 156/507; 242/554.1; 242/555.2

[58] Field of Search ..... 156/157, 159, 156/304.3, 304.5, 502, 505, 507; 242/553, 554.1, 555.2, 556.1

[56] References Cited

U.S. PATENT DOCUMENTS

| | | | |
|---|---|---|---|
| 3,314,844 | 4/1967 | Hadley | 156/505 X |
| 3,554,842 | 1/1971 | Byrt . | |
| 3,824,143 | 7/1974 | Cooper et al. | 156/505 X |
| 3,939,032 | 2/1976 | Taitel et al. | 156/505 |
| 4,120,739 | 10/1978 | Peeters et al. . | |
| 4,328,066 | 5/1982 | Kiuchi et al. | 156/157 X |
| 4,401,504 | 8/1983 | Kobayashi | 156/505 |
| 4,512,828 | 4/1985 | Helm | 156/502 X |
| 4,555,070 | 11/1985 | Pali | 156/157 X |
| 4,769,098 | 9/1988 | Cederholm et al. . | |
| 5,468,321 | 11/1995 | van Liempt et al. . | |
| 5,656,125 | 8/1997 | Tanaka | 156/505 X |

*Primary Examiner*—Mark A. Osele

[57] ABSTRACT

An apparatus and method for setting a gap between webs has a clamp assemblage which includes a pair of clamp members for securing and moving a trailing end of an expiring web into a spaced relations with the leading end of a fresh web. An actuator moves the clamp members securing the expiring web along guide rails to a predetermined position for setting the gap width between the ends of web.

12 Claims, 3 Drawing Sheets

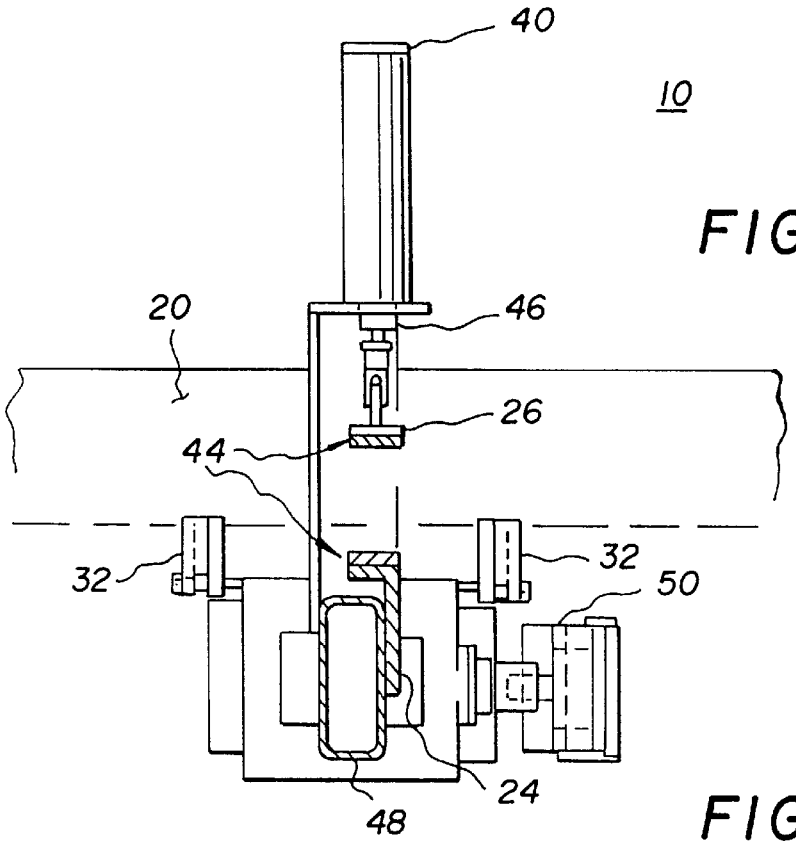
FIG. 3
FIG. 4
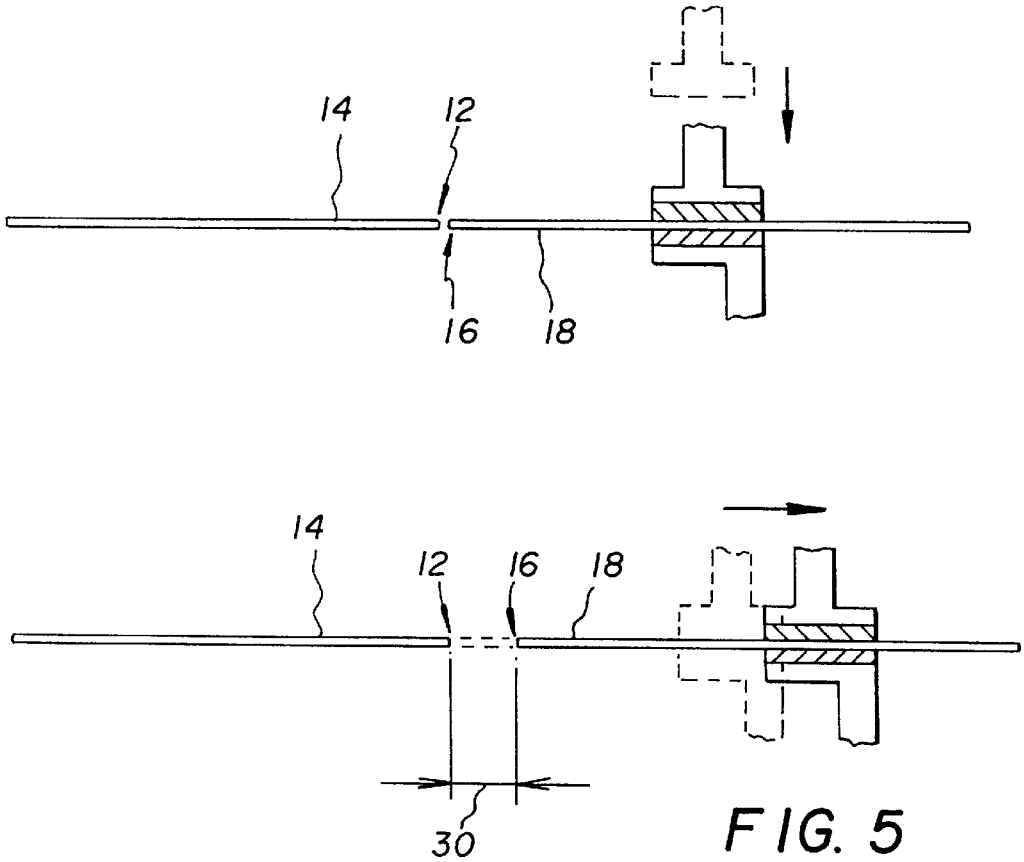
FIG. 5

APPARATUS AND METHOD FOR SETTING A GAP BETWEEN STRIPS OF WEB

FIELD OF THE INVENTION

This invention relates generally to converting processes/equipment and, more particularly, to methods and apparatus for precision splicing two webs by setting a gap between an expiring web and a new web prior to applying a splicing medium.

BACKGROUND OF THE INVENTION

Conveyance of webs in a continuous manufacturing process utilize splicing apparatus which joins an expiring (conveying) web to the leading edge of a new (entering) web at zero speed. Accumulators, or take-ups, are generally used to allow the manufacturing line to continue at production speed while the splicing process is completed at zero speed. In the manufacture of sensitized film and paper products, a precision uniform splice gap is required to insure trouble-free conveyance and reduce probability of splice related coating disturbances. In many zero speed butt splicing processes, the leading edge of the new web is overlapped with the trailing edge of the expiring web, both webs are clamped and a knife/cutter assembly trims both ends via a cross-cut. Splice tape is applied over the cut with no provision for generating a slight gap between the cut ends of the web.

Automated zero speed butt splicing equipment is used in many converting applications to join together two webs, a new web and progressing (or expiring) web, allowing continuous operation of the manufacturing line. Butt splicing equipment is also commonly used in manufacture of sensitized film and paper products, where splice characteristics can adversely affect the applied emulsion coatings. In most applications, no provision is made to produce a splice with uniform and specific gap dimensions. Lack of this capability on butt splicing equipment used in the manufacture in sensitized film and paper products can produce splices which can cause coating imperfections and conveyance related problems. Splices which are overlapped, for example, will cause coating imperfections due to a disruption in the coating process. Such disruptions are attributed to the increased thickness as the splice conveys through the coating station. A second cause of coating disturbances is due to non-uniform splice gap, which can generate coating imperfections which are generally persistent as the web continues to convey. A splice without a gap of sufficient width will hinge, i.e., buckle at the point of connection, when conveyed over a roller. This hinging of the web progressively weakens the splice tape at the hinge line (web connection line) as the web is conveyed over successive rollers. Of course, the probability of web tearing also increases with hinging. These problems are very costly and can result in significant waste and unscheduled machine down time.

Various attempts have been made in the prior art to minimize the problems described above. For instance, U.S. Pat. No. 4,120,739 discloses splice gap setting capability (refer to column 7, lines 4–21) which consists of a butt control bar which advances until its free edge contacts the web and introduces a slight bow in the web, which is clamped. This system requires the cut-off edge of the web to be pulled through the clamp, which can create significant web tension and induce tearing. Clamping pressure is adjusted to prevent web tearing as the web is pulled through. However, due to non-uniformity in the web, such as planarity and camber, prevention of tearing and the ability to generate uniform splice gap width are questionable using this method described in this invention. Differences in elasticity of webs used with this process may also result in gap width variability. The patent states gap setting capability is between 0.1 and 0.3 mm.

In U.S. Pat. Nos. 5,468,31 and 3,554,842 butt splicing apparatus is disclosed that lacks an active splice gapping capability for solving the aforementioned problems.

In U.S. Pat. No. 4,769,098, a butt splice apparatus has a method for moving the held portion of the new web from a first position to a second position where it is closely adjacent to the stopped portion of the expiring web (refer to column 4, lines 8–19). There is no provision for positioning the webs for a pre-selected gap setting therebetween.

Therefore, there persists a need for an apparatus and method for setting a gap of predetermined width between webs prior to splicing that is easy to use, reliable, and eliminates web defects usually associated with high production speed splicing operations.

SUMMARY OF THE INVENTION

It is, therefore, an object of the present invention to provide an apparatus and method that introduces a predetermined splice gap between the webs before joining.

It is another object of the invention to provide an apparatus and method that utilizes an adjustable clamp assemblage for setting the splice gap between the webs to be joined.

Still another object of the invention is to provide an apparatus and method that requires minimum production space.

It is a feature of the present invention that the apparatus for setting a gap between webs uses a pair of clamp members for securing and moving a trailing end of an expiring web into close proximity with the leading end of a fresh web so as to form the gap between the trailing and leading ends prior to joining the webs.

To accomplish these and other objects, there is provided, in one aspect of the invention, an apparatus for setting a gap between a leading end of a fresh, stationary web and a trailing end of an expiring web includes means for securing said expiring web. The means for securing has a first, fixed clamp member and a second, movable clamp member for clamping the expiring web therebetween. The second clamp member is mounted for vertical movement relative to the first clamp member. Means for actuating the second clamp member to move vertically is provided. A pair of linear guides operably sidably supports the means for securing. The linear guides enable the first and second clamp members after securing the expiring web to move, on the one hand, translationally from a first position at which the expiring web and the fresh web are simultaneously cut to form the leading end of the fresh web and the trailing end of the expiring web. On the other hand, the linear guides enable the clamp members to move translationally to a second position at which the trailing end is displaced by a predetermined distance from the leading end of the fresh web to form a splice gap between the trailing edge and the leading edge. Moreover, means cooperating with the linear guides are provided for limiting the translational movement of the means for securing.

In another aspect of the invention, a method of setting a predetermined gap between a fresh web and an expiring web includes the step of providing an expiring web exposing a trailing end and fresh web exposing a leading end, and then moving the trailing end translationally into close proximity with the leading end with a movable clamp assemblage, as described above. A stopping member is used to restrict the movement of the clamp assemblage at a predetermined distance from the leading end thereby forming a gap width between the trailing end of the expiring web and the leading end of the fresh web.

Therefore, there are numerous advantageous effects of the apparatus and method of the invention, for instance: the formation of the splice gap set between the ends of web minimizes the opportunity for splice hinging thereby reducing web shrinkage; the predetermined gap eliminates the need for web tension to induce a desired gap width, thus reducing risk of web tearing and increasing process latitude; the splice gap eliminates variability in splice gap width due to elasticity differences between varying web materials; and, the splice gap increases splicing process reliability by reducing splice failures and product waste resulting from non-uniform or overlapped splices.

BRIEF DESCRIPTION OF THE DRAWINGS

The above mentioned objects, features and advantages of the invention and the manner of attaining them will become more apparent and the invention itself will be better understood by reference to the following description of an embodiment of the invention taken in conjunction with the accompanying drawings wherein like numeral denote like elements, and wherein:

FIG. 3 is an end elevation view of the apparatus, partially sectioned to show the arrangement of the first and second clamp members;

FIG. 4 is a schematic of the clamp assemblage securing a web in the first position;

FIG. 5 is a schematic of the clamp assemblage shown in FIG. 4 in the second position;

DETAILED DESCRIPTION OF THE PREFERRED EMBODIMENT

Figure 1:
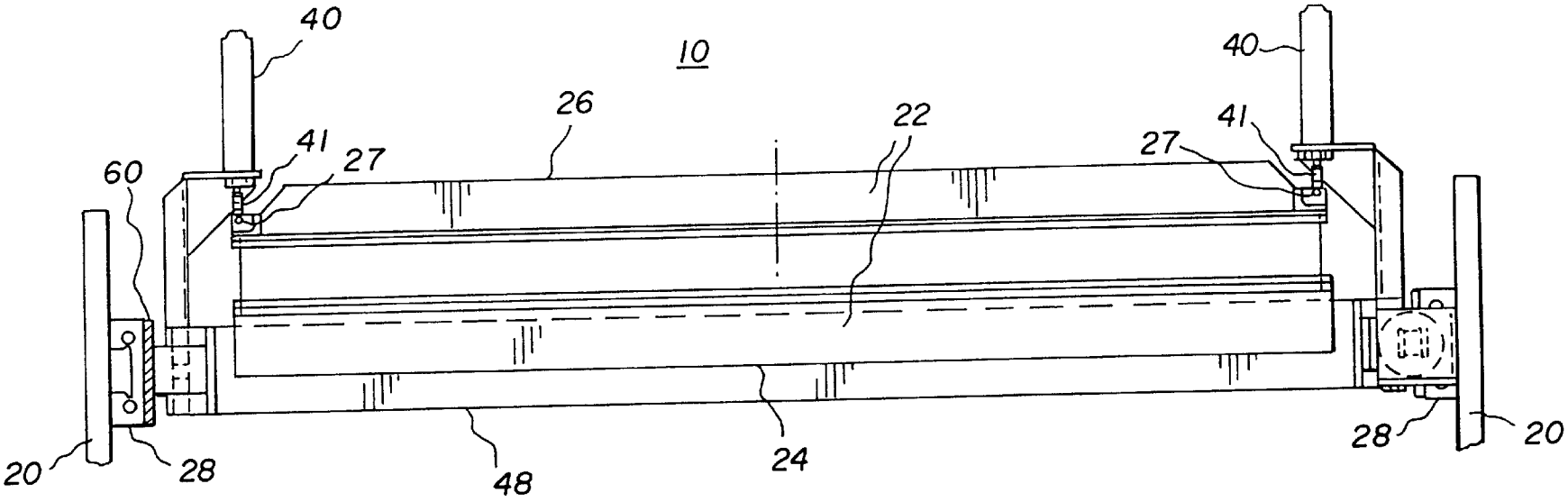
FIG. 1 is a front elevation view of the apparatus of the invention.
Figure 2:
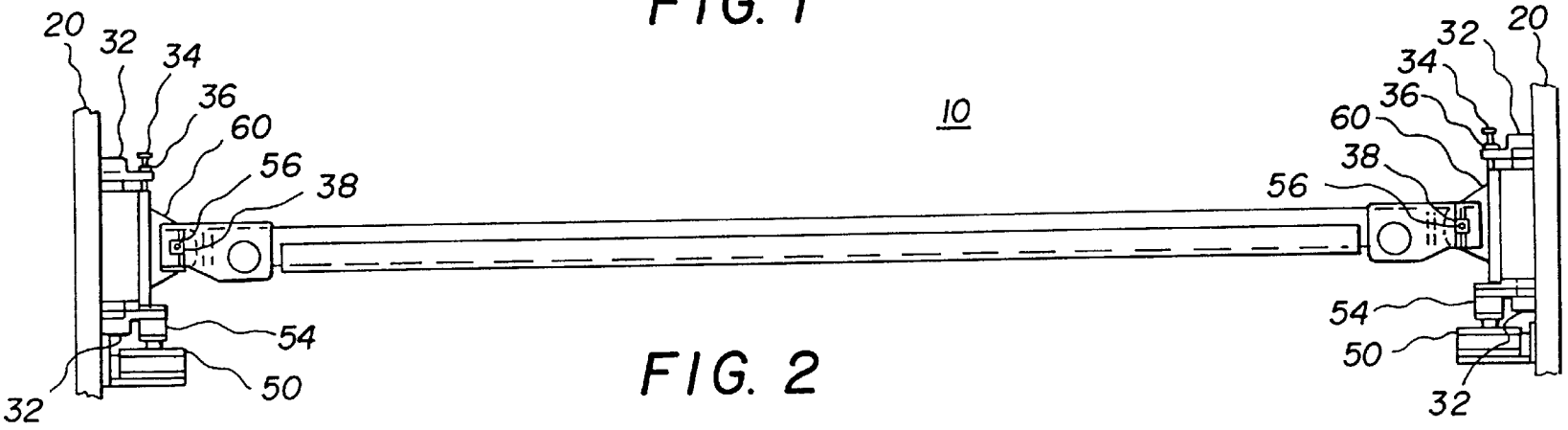
FIG. 2 is a plan view of the apparatus of the invention.

Turning now to the drawings, and in particular to FIGS. 1–3, broadly defined, the apparatus 10 for joining a leading end 12 of a fresh web 14 and a trailing end 16 of an expiring web 18 comprises a frame 20, preferably made of a rigid material, such as plastic or metal, for supporting elements of apparatus 10. Fresh web 14 having a leading end 12 and expiring web 18 having a trailing end 16 are shown clearly in FIGS. 4 and 5. Webs 14, 18 may have any width and be of indeterminate length.

In one embodiment of the invention, a clamping assemblage 22 secures the expiring web 18 in a spaced relation, as described below, to the fresh web 14. As will become more obvious, clamping assemblage 22 is sidably mounted to frame 20. Preferably, clamping assemblage 22 includes a first, fixed clamp member 24 and a second, movable clamp member 26 for clamping the expiring web 18 therebetween, as shown clearly in FIGS. 1 and 3.

Movable clamp member 26 is mounted for vertical movement toward and away from the fixed clamp member 24. When movable clamp member 26 is actuated to move vertically toward the fixed clamp member 24 (preferably downwardly), the clamp assemblage 22 is in a closed position for closing upon the expiring web 18 and securing it against further translational movement. Conversely, when the movable clamp member 26 is actuated to move vertically away from fixed clamp member 24 (preferably upwardly), the clamp assemblage 22 is in an open position for releasing and/or receiving the expiring web 18.

As seen in FIGS. 1 and 3, movable clamp member 26 is actuated for vertical movement by, preferably a second pneumatic cylinder 40, such as one manufactured by Bimba Manufacturing Company of Monee, Ill. Referring to FIG. 3, second pneumatic cylinder 40 is mounted to a cross tie 48 via a cylinder nut 46. In FIG. 1 and 3, a first cylinder clevis 41 is preferably arranged between the pneumatic cylinders 40 and the movable clamp member 26 (via a first pin member 27) for providing limited freedom of rotation of the movable clamp member 26 when the movable clamp member 26 is moving vertically to prevent mechanical binding.

Figure 6:
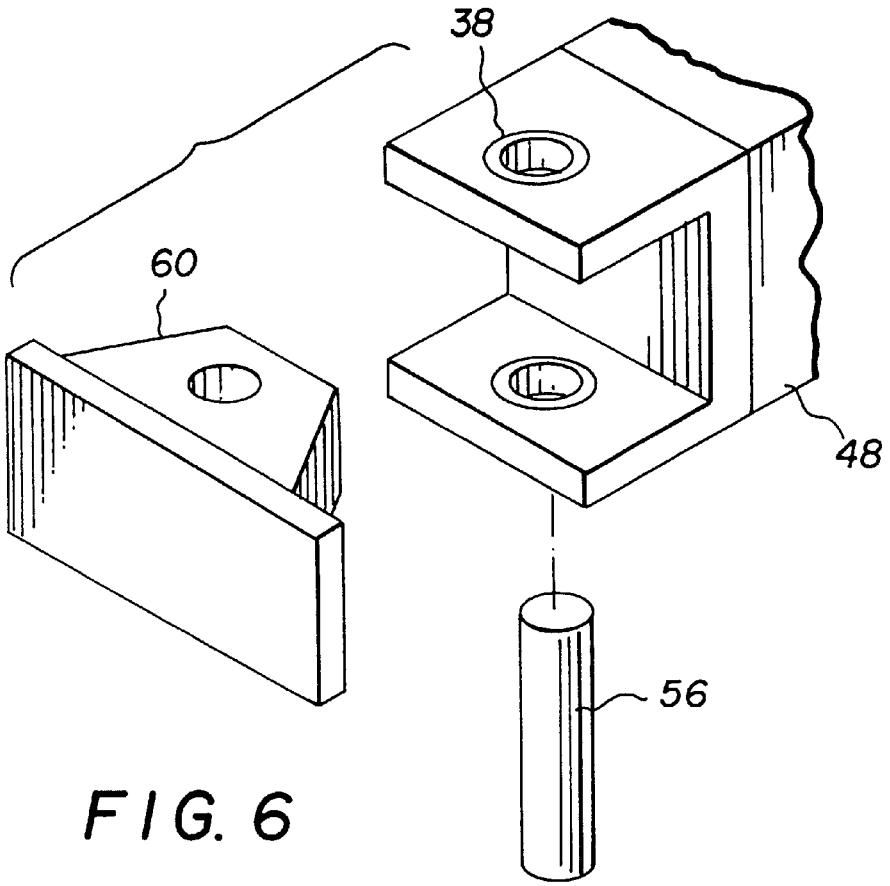
FIG. 6 is an isometric view of the cross tie, partially exploded to show the clevis.

Referring to FIG. 5, first pneumatic air cylinders 50 (FIGS. 2 and 3), or other activating means, are preferably used to move the clamp assemblage 22 translationally in the direction of web travel (shown by arrows). A cylinder clevis 54 is connected to first pneumatic cylinders 50, as seen in FIGS. 1 and 2, for joining cylinders 50 to the linear guides 20 via a push clevis 60. Referring to FIG. 6, a nylon bearing 38 is inserted in the push clevis 60 for providing smooth actuating movement of the clamp assemblage 22. Push clevis 60 is affixed to the cross tie 48 by a pin 56 snugly arranged in an aligned through opening in the cross tie 48 and push clevis 60 to provide freedom of rotation of cross tie 48 thereby preventing mechanical binding during translational movement. Push clevis 60 is fixed to the linear guides 28 using a plurality of bolts (not shown). So as to limit the extent of translational movement or travel of clamp assemblage 22, adjustable mechanical stops or stop members 32 are arranged on the apparatus 10, described in more detail below.

As more clearly seen in FIGS. 1–3, frame 20 supports a pair of linear guides 28 arranged on either side of frame 20. A plurality of bolts (not shown) are used to mount linear guides 20 onto the frame 20. Linear guides 28 provide slidable support for clamping assemblage 22. More particularly, linear guides 28 enable the fixed and movable clamp members 24, 26, after securing the expiring web 18, to move translationally or linearly in the direction (shown by arrow in FIG. 5) of the web travel. Clamp assemblage 22 moves from a first position at which the expiring web 28 and the fresh web 14 are simultaneously cut forming leading end 12 of fresh web 14 and a trailing end 16 of the expiring web 18. Thereafter, linear guides 28 enable clamp members 24, 26 to move translationally to a second position at which the trailing end 16 is displaced by a predetermined distance relative to the leading end 12 of the fresh web 14 to form a splice gap 30 between trailing end 16 and leading end 12.

Figure 7:
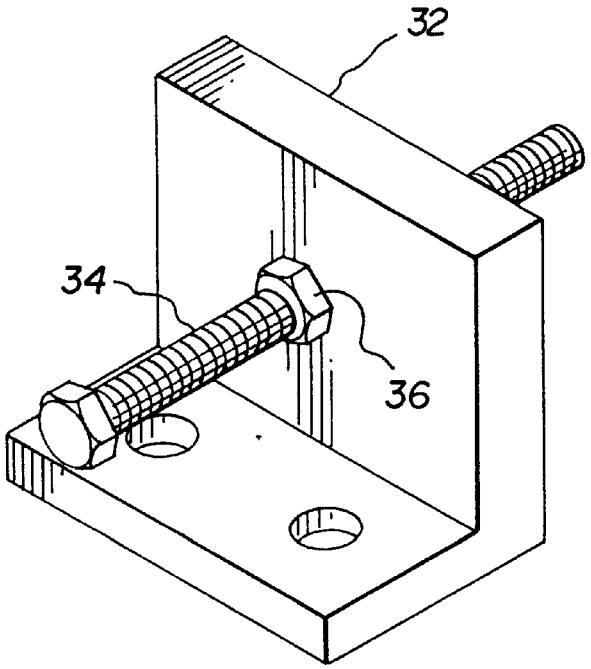
FIG. 7 is an isometric view of the stop member.

Since it is apparent that splice gap 30 (FIG. 5) is determined by the extent of separation between the fresh and expiring webs prior to splicing, stop members 32 are arranged for limiting the translational travel of the clamp assemblage 22 along linear guides 28. While there are various ways for limiting the translational movement of clamp assemblage 22, we prefer using stop members 32 comprising a threadable screw 34 having a locking nut 36 (FIGS. 2 and 7) for setting a predetermined distance which the clamping assemblage 22 can move along linear guides 28. Thus by properly adjusting the threadable screw 34 into the locking nut 36, the splice gap 30 is predetermined for a particular web splice. Stop members 32 are preferably bolted to the frame 20, although a variety of fastening means may used, such welding. We used two bolts (not shown) to mount the four stop members 32, two being on either side of frame 20 for interfering with the travel of clamp assemblage 22. Other ways to limit the translational movement of clamp assemblage 22 within the contemplation of the invention include solid, nonadjustable stops (not shown).

Although a variety of means may be used to apply an adhesive medium across splice gap 30 thereby joining fresh web 14 and the expiring web 18, we prefer a tape dispenser (not shown) and an adhesive material such as tape.

Referring to FIG. 3, fixed and movable clamp members 24, 26 comprise a compliant material layer 44 for making contact with the expiring web 19. Compliant material layer 44 may affixed to the clamp members 24, 26 by any means, for example, glued, screwed and casted directly onto the clamp members 26, 26. Preferably, the compliant material layer 44 comprises polyurethane, although other materials can be used such as silicones and closed cell foams.

According to FIG. 3, cross tie 48 supports the first, fixed clamp member 24. A plurality of bolts (not shown) are used to secure the fixed clamp member 24 to cross tie 48.

In operations, a web of indeterminate length is threaded into the splicing apparatus. The splicing sequence is activated and the fresh and expiring webs 14, 18 are cut simultaneously. Immediately after the webs 14, 11 are cut, clamp assemblage 22, which is moveable in the lengthwise direction of the web, is automatically positioned to displace one end to achieve a uniform splice gap 30 between the leading end 12 of the fresh web 24 and the trailing end 16 of the expiring web 18. The splice tape (not shown) is applied over the leading and trailing ends 12, 16 of the webs 14, 18, which have been separated by the desired amount using the apparatus of the invention, to join them together and maintain gap uniformity. It is therefore important to the invention that one end of a cut web be displaced relative to an end of another web in a controlled manner to produce a butt splice with selectable and precise gap width and minimal splice gap 30 variability. After splice tape is applied, the movable clamp member 26 is disengaged to release the newly joined webs and the clamp assemblage 22 returns to its original position in preparation for the next splicing cycle.

PARTS LIST

10 . . . . apparatus
12 . . . . leading end
14 . . . . fresh web
16 . . . . trailing end
18 . . . . expiring web
20 . . . . frame
22 . . . . clamping assemblage
24 . . . . fixed clamp member
26 . . . . movable clamp member
27 . . . . first pin member
28 . . . . linear guides
30 . . . . splice gap
32 . . . . stop members
34 . . . . threadable screw
36 . . . . locking nut
38 . . . . nylon bearing
40 . . . . second pneumatic cylinder
41 . . . . first cylinder clevis
44 . . . . compliant material layer
46 . . . . cylinder nut
48 . . . . cross tie
50 . . . . first pneumatic air cylinders
54 . . . . cylinder clevis
56 . . . . pin
60 . . . . push clevis While the invention has been described with particular reference to a preferred embodiment, it will be understood by those skilled in the art the various changes can be made and equivalents may be substituted for elements of the preferred embodiment without departing from the scope of the invention. In addition, many modifications may be made to adapt a particular situation in material to a teaching of the invention without departing from the essential teachings of the present invention.

What is claimed is:

1. Apparatus for setting a gap between a leading end of a fresh, stationary web and a trailing end of an expiring web, said apparatus comprising:

means for securing said expiring web, said means for securing comprising a first, fixed clamp member and a second, movable clamp member for clamping the expiring web therebetween, said second clamp member being mounted for vertical movement relative to said first clamp member;

means for actuating said second clamp member;

a pair of linear guides operably associated with said means for securing, said means for securing being supported by a cross tie and said cross tie being affixed to said linear guides and wherein a clevis is arranged in said cross tie for providing freedom of rotation of said cross tie when said means for securing moves translationally, and wherein said linear guides enable said first and second clamp member after securing said expiring web to move translationally from a first position at which said expiring web and said fresh web are simultaneously cut to form said leading end of said fresh web and said trailing end of said expiring web, to a second position at which said trailing end is displaced by a predetermined distance from the leading end of said fresh web to form a splice gap between said trailing end and said leading end; and, means cooperating with said linear guides for limiting said translational movement of said means for securing.

2. The apparatus recited in claim 1, wherein said means for actuating comprises pneumatic cylinders.

3. The apparatus recited in claim 2, wherein a clevis is arranged between the pneumatic cylinders and second clamp member for providing freedom of rotation of said second clamp bar when said clamp member is moving vertically.

4. The apparatus recited in claim 1, wherein said first and second clamp members comprise a compliant material for contacting said expiring web.

5. The apparatus recited in claim 4, wherein said compliant material is polyurethane.

6. The apparatus recited in claim 1, wherein said clevis is bolted to said linear guides.

7. The apparatus recited in claim 1, wherein said cross tie fastened to said clevis by a pin.

8. The apparatus recited in claim 1, wherein a stop block is arranged along said linear guides for restricting translational movement of means for securing.

9. The apparatus recited in claim 8, wherein a threadable screw having a locking nut for setting a predetermined distance which the means for securing can move.

10. Method of setting a predetermined gap width between a fresh web and an expiring web, comprising the steps of:

(a) providing an expiring web exposing a trailing end and a fresh web exposing a leading end;

(b) moving said trailing end of said expiring web into proximity with said leading end of said fresh web;

(c) providing means for setting a predetermined gap between said trailing end of said expiring web and said leading end of said fresh web, said means comprising a clamp assemblage for securing said expiring web, said clamp assemblage comprising a first, fixed clamp member and a second, movable clamp member for clamping the expiring web therebetween, said second clamp member being mounted for vertical movement relative to said first clamp member; means for actuating said second clamp member; a pair of linear guides slidably supporting said clamp assemblage, said clamp assemblage being supported by a cross tie and said cross tie being affixed to said linear guides and wherein a clevis is arranged in said cross tie for providing freedom of rotation of said cross tie when said clamp assemblage moves translationally, and wherein said linear guides enable said first and second clamp members after securing said expiring web to move translationally from a first position at which said expiring web and said fresh web are simultaneously cut to form said leading end of said fresh web and said trailing end of said expiring web, to a second position at which said trailing end is displaced a predetermined distance from said leading end of said fresh web to form a splice gap between said trailing end and said leading end; and, means for applying an adhesive layer across said trailing end, said splice gap and said leading end thereby joining said fresh web and said expiring web; and, (d) securing said trailing end of said expiring web in said clamp assemblage;

(e) moving said clamp assemblage translationally toward said stationary leading end of said fresh web;

(f) stopping said clamp assemblage at a predetermined distance from said leading end thereby forming a gap width between said trailing end of said expiring web and said leading end of said fresh web.

11. The method recited in claim 10 wherein said step of stopping said clamp assemblage comprises adjusting a stop member arranged for restricting the movement of the clamp assemblage on the linear guides.

12. The method recited in claim 11, wherein said step of adjusting includes the step of turning a threadable screw into or out of a fastening bolt arranged in the frame.

* * * * *